US005720070A

United States Patent [19]

Kelley et al.

[11] Patent Number: 5,720,070

[45] Date of Patent: Feb. 24, 1998

[54] WELD CLEANING MACHINE

[75] Inventors: Aaron D. Kelley, Spring Valley; William B. Bonow, Plainfield; Kenneth R. Pierce, Lake Zurich, all of Ill.

[73] Assignee: Commonwealth Edison Company, Chicago, Ill.

[21] Appl. No.: 619,250

[22] Filed: Mar. 21, 1996

[51] Int. Cl.[6] ..... B08B 9/02

[52] U.S. Cl. ..... 15/88; 451/441; 405/154; 15/104.04

[58] Field of Search ..... 15/88, 104.04; 451/92, 441; 405/154, 157

[56] References Cited

U.S. PATENT DOCUMENTS

| | | | |
|---|---|---|---|
| 2,499,655 | 3/1950 | Laurent | 15/88 |
| 2,823,398 | 2/1958 | Curran . | |
| 3,641,608 | 2/1972 | Kratt . | |
| 3,816,861 | 6/1974 | Jungle | 451/441 |
| 3,916,469 | 11/1975 | Anthem | 15/88 |
| 4,007,705 | 2/1977 | Sherer et al. . | |
| 4,011,690 | 3/1977 | Braithwaite | 451/92 |
| 4,205,407 | 6/1980 | King | 15/88 |
| 4,720,213 | 1/1988 | Gernhardt et al. . | |
| 5,001,801 | 3/1991 | Jarvis et al. . | |
| 5,069,234 | 12/1991 | Nielsen . | |
| 5,136,969 | 8/1992 | Chapman . | |
| 5,199,226 | 4/1993 | Rose . | |

FOREIGN PATENT DOCUMENTS

| | | |
|---|---|---|
| 155 810 | 7/1982 | Germany . |
| 530765 | 4/1977 | U.S.S.R. . |
| 1007766 A | 3/1983 | U.S.S.R. . |
| 2 082 948 | 3/1982 | United Kingdom . |

OTHER PUBLICATIONS

Wachs Trav-L-Cutter, Product Brochure, E.H. Wachs Company, Wheeling, IL, Dec. 1995.

Wachs Trav-L-Cutter, Product Brochure, E.H. Wachs Company, Wheeling, IL, Mar. 1995.

Wachs Utility Pipe Cutter, Product Brochure, E.H. Wachs Company, Wheeling, IL, Revised Aug., 1995.

Wachs Heavy Duty Mill, Product Brochure, E.H. Wachs Company, Wheeling, IL, Sep., 1994.

*Primary Examiner*—Randall Chin

*Attorney, Agent, or Firm*—Brinks Hofer Gilson & Lione

[57] ABSTRACT

A weld cleaning machine includes a frame which is secured by a roller chain immediately adjacent to a pipe having a weld to be cleaned. A rotary weld cleaning element is mounted to the frame on an oscillating arm such that the weld cleaning element oscillates along an oscillation axis oriented axially with respect to the pipe. A first motorized drive system is mounted on the frame to rotate the frame circumferentially around the pipe. A second motorized drive system is mounted on the frame to oscillate the weld cleaning element along the oscillation axis. A third motorized drive system is included in the oscillating arm to rotate the weld cleaning element. The weld cleaning machine is controlled remotely via a control cable and a control panel such that the operator can stand some distance from the pipe being cleaned. Preferably the machine automatically performs a programmed sequence of motions to clean a strip of substantial width along the axis of the pipe.

20 Claims, 7 Drawing Sheets

12
10
14
16
18
20
22
24
28
30
32
34
36
38
40
42
44
50
52
54
56
60
66
70
76
100
102
104
105
112
P1

WELD CLEANING MACHINE

BACKGROUND OF THE INVENTION

This invention relates to a machine for cleaning a weld around the circumference of a pipe.

Pipe welds are occasionally subject to inspection, and are typically cleaned prior to inspection. This procedure is routinely performed in pipes of varying sizes in nuclear power plants. Such pipes can be a source of ionizing radiation, and it is therefore advantageous to minimize the time operating personnel must be positioned immediately adjacent the pipe during the cleaning operation. For this reason, there is a need in the art for an automatic weld cleaning machine which cleans a pipe weld properly for inspection while reducing the time an operator must be in close proximity to the pipe.

SUMMARY OF THE INVENTION

According to this invention, a weld cleaning machine is provided comprising a frame, a band comprising first and second portions coupled to the frame to hold the frame against a pipe, a weld cleaning element mounted to the frame for rotation, and a first motorized drive system mounted to the frame to rotate the frame around the pipe.

According to a first aspect of this invention, a weld cleaning machine of the type described above utilizes a weld cleaning element that is mounted to the frame for oscillation along an oscillation axis positioned at a non-zero angle (such as 90° in the embodiment described below) with respect to the plane of the band. A second motorized drive system is mounted on the frame to oscillate the weld cleaning element along the oscillation axis. In this way the weld cleaning machine can be used to clean an annular strip around the circumference of the pipe which has a greater axial length than the axial length of the weld cleaning element itself.

According to a second aspect of this invention, a weld cleaning machine of the type described initially above is provided with a control cable connected to at least the first drive system and a control panel connected to the control cable to control the first drive system remotely. This arrangement allows an operator to stand at a distance from the pipe being cleaned, and thereby minimizes radiation exposure to the operator in the event the pipe is a source of ionizing radiation.

According to a third aspect of this invention, a weld cleaning machine of the type described initially above is provided with a motor coupled to the weld cleaning element and means for mounting the weld cleaning element for movement with respect to the frame toward and away from the pipe. A spring is coupled between the mounting means and the weld cleaning element and is operative to bias the weld cleaning element against the pipe. This arrangement provides a controlled biasing force for the cleaning element against the pipe, and thereby leads to a consistent, effective cleaning action.

According to a fourth aspect of this invention, a weld cleaning machine of the type described initially above includes a pair of first drive wheels in the first motorized drive system. These drive wheels are mounted for rotation about a drive axis to roll around the pipe, and a drive motor is coupled to the drive wheels. The frame includes a sub-frame comprising a pair of guide wheels positioned on a guide axis to roll around the pipe. The sub-frame is movably mounted on the frame to allow adjustment of the separation between the drive and guide axes. In this way the weld cleaning machine can readily be adapted for use with pipes having a wide range of sizes.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
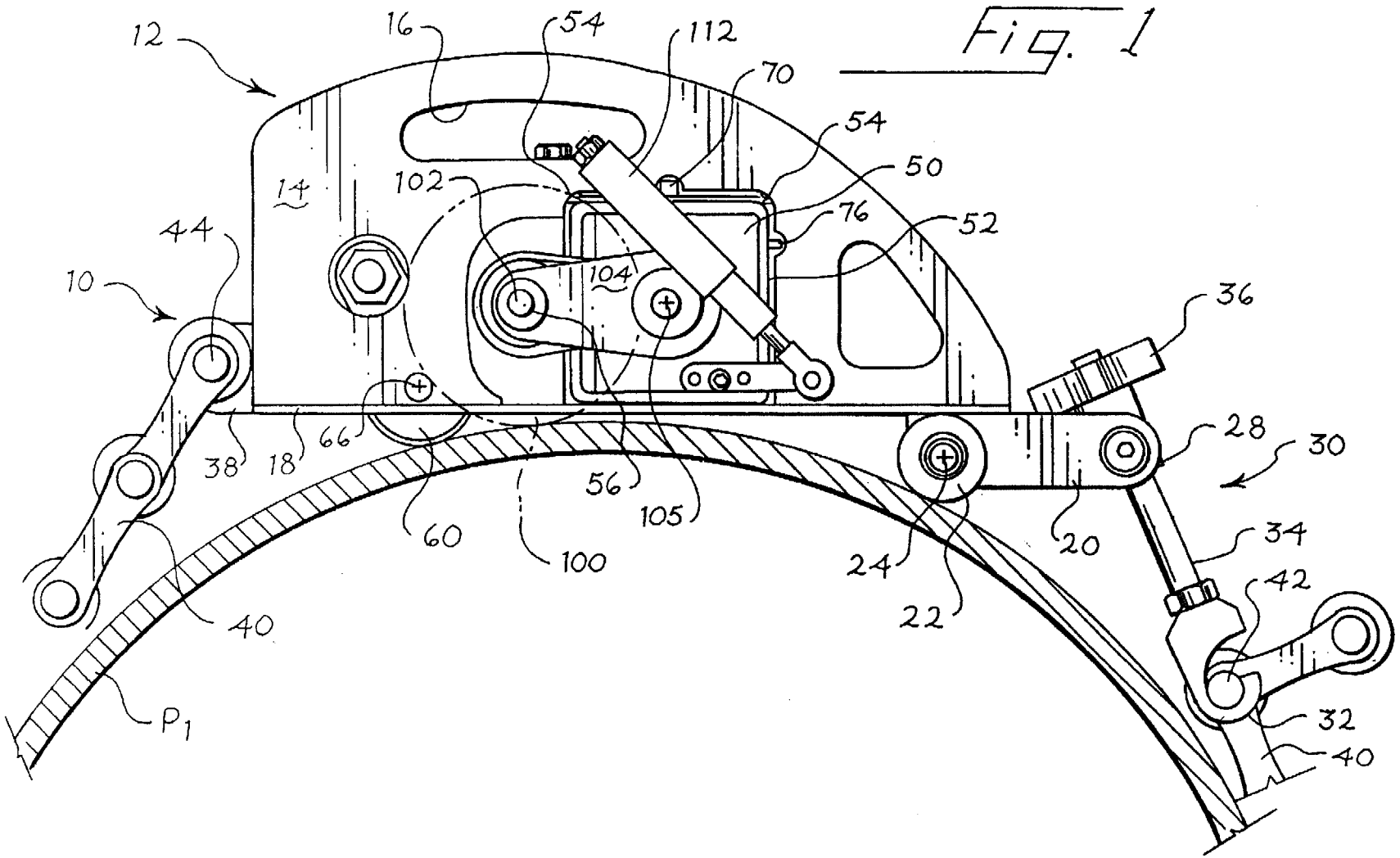
FIG. 1 is a side view of a weld cleaning machine which incorporates a presently preferred embodiment of this invention, mounted in place on a larger pipe.
Figure 2:
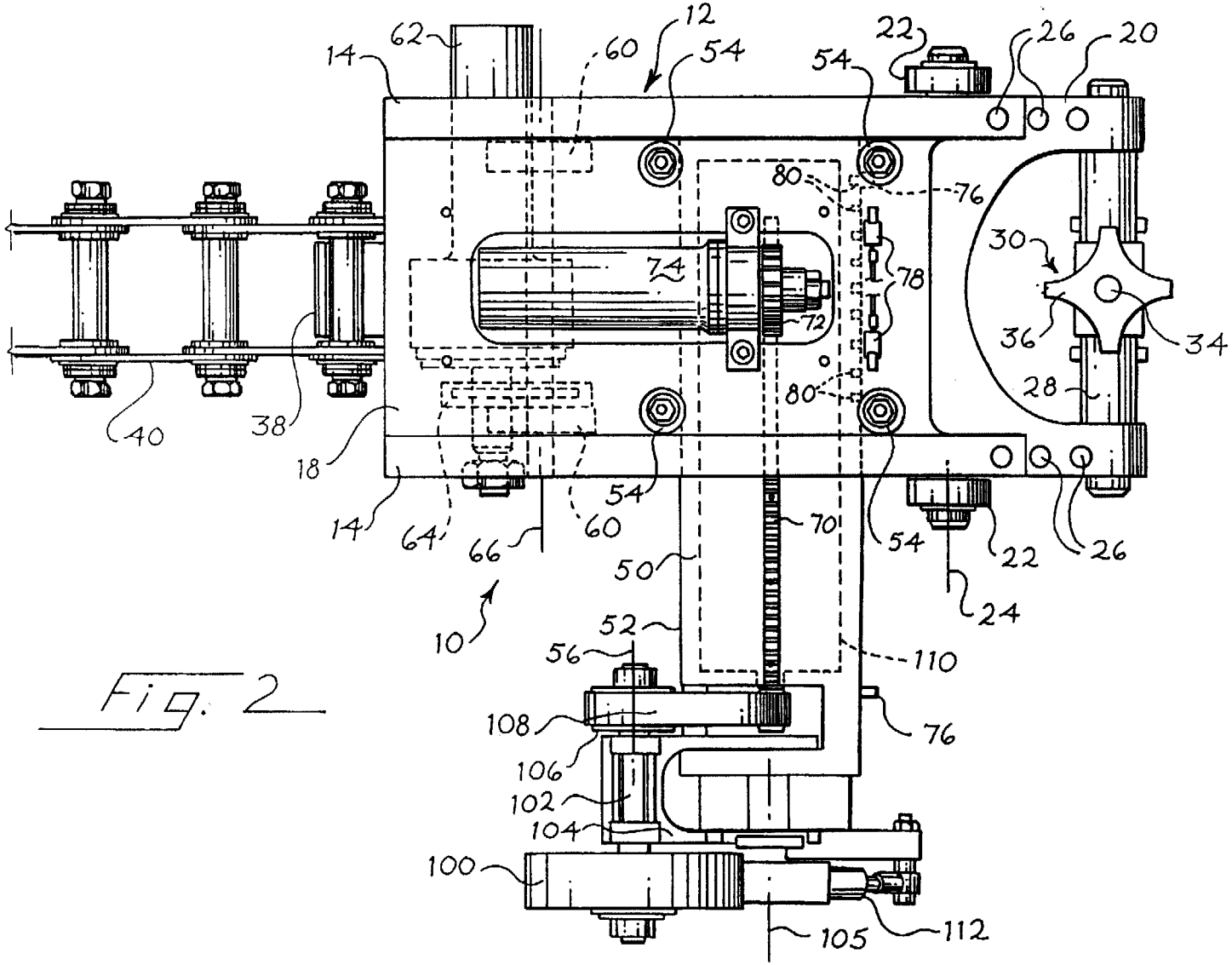
FIG. 2 is a top view of the weld cleaning machine of FIG. 1.

Turning now to the drawings, FIGS. 1 and 2 show overall views of a weld cleaning machine 10; in FIG. 1 the machine is shown mounted on a larger pipe P1. The weld cleaning machine includes a frame 12 which in turn includes two spaced, parallel side plates 14 rigidly connected to a bottom plate 18. Each of the side plates 14 defines a gripping opening 16 which serves as a handle, allowing the weld cleaning machine to be gripped and positioned by the user on the pipe to be cleaned.

A sub-frame 20 is included in the frame 12 and is adjustably mounted at one end of the frame 12. The sub-frame 20 mounts a pair of guide wheels 22 which are positioned to roll around the circumference of the pipe P1. The guide wheels are mounted to rotate with respect to the sub-frame 20 about a guide axis 24. The sub-frame 20 defines two arrays of openings 26, and the sub-frame 20 can be bolted to the side plates 14 at any one of a number of predetermined positions, as described below. Preferably, these pre-determined positions are defined by pins (not shown) which fit precisely into alignment openings (not shown). The sub-frame 20 pivotably supports a crossbar 28 that in turn supports a chain tensioner 30. The chain tensioner 30 includes a hook 32 that is fixedly secured to a shaft 34. The upper end of the shaft 34 is threaded and fits within a threaded handle 36. By rotating the handle 36 the effective length of the shaft 34 can be varied as described below. A second hook 38 is rigidly positioned on the opposite side of the frame 12 from the sub-frame 20.

A roller chain 40 can be quickly secured to or released from the hooks 32, 38. The roller chain 40 includes a first portion 42 which is connected to the hook 32 and a second portion 44 which is connected to the hook 38. When the roller chain is secured to the hooks 32, 38 the roller chain 40 preferably passes around the entire circumference of the pipe P1, such that the roller chain 40 secures the weld cleaning machine 10 in position against the pipe P1. The handle 36 and the shaft 34 can be used to supply the desired degree of tension to the roller chain 40.

The roller chain 40 is presently preferred because it moves smoothly across the surface of the pipe P1. However, it should be understood that other types of bands can be substituted for the roller chain 40 in alternate embodiments. For example, various types of flexible tensioning bands can be used, including webbing and other types of chains.

The frame 12 also includes an oscillating arm 50. This oscillating arm 50 in this embodiment includes a box channel 52 which is oriented substantially at right angles to the plane of the roller chain 40. The box channel 52 is movably mounted in the remainder of the frame 12 by roller guides 54. In this embodiment the roller guides 54 each define a V groove which receives the side edges of a top plate mounted to the box channel 52. The cooperation between the side edges and the guides 54 constrains the oscillating arm 50 to axial movement, along an oscillation axis 56 that is in this embodiment oriented transverse to the roller chain 40 and axially with respect to the pipe P1. In other embodiments the oscillation axis 56 can be oriented at other non-zero angles with respect to the roller chain 40.

The frame 12 supports two drive wheels 60 which are included in a first motorized drive system. These drive wheels 60 rotate around a drive axis 66 that is fixed with respect to the frame 12. The drive wheels 60 are rotated in unison by a radial drive motor 62 which is coupled to the drive wheels 60 by a closed loop chain 64. When the drive motor 62 is powered, it rotates the drive wheels 60, thereby propelling the frame 12 and the roller chain 40 as a unit circumferentially around the pipe P1.

Figure 5:
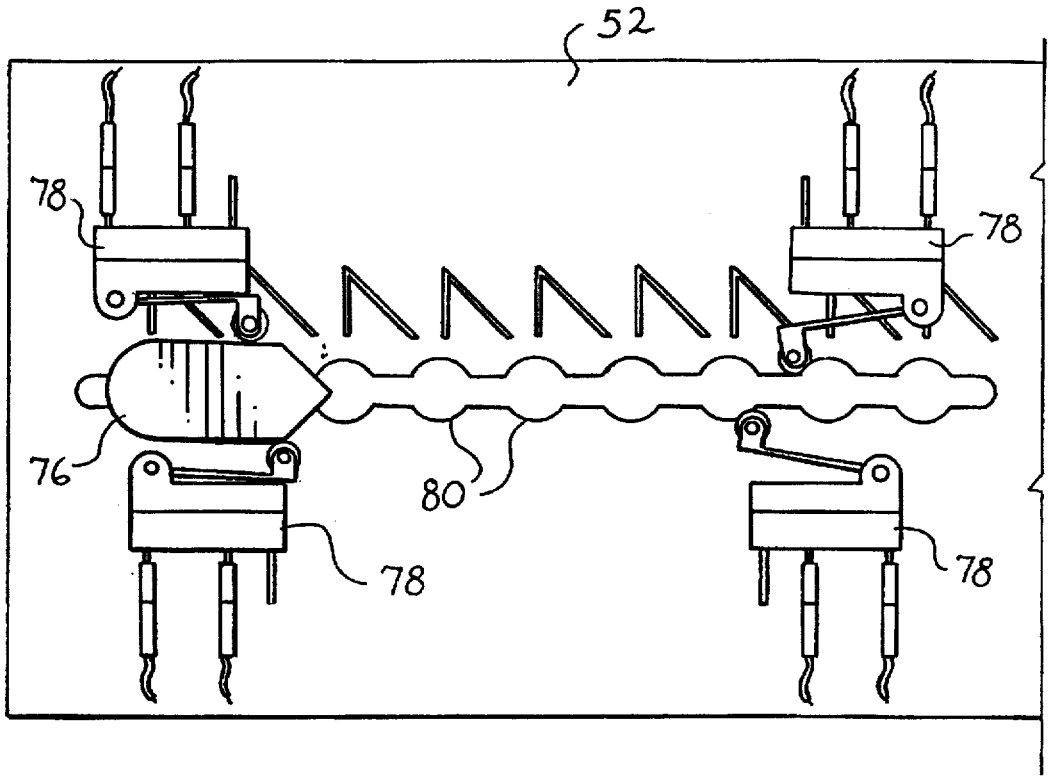
FIG. 5 is a detailed view of a portion of the weld cleaning machine of FIGS. 1, 2 and 4.

The weld cleaning machine 10 includes a second motorized drive system which in this embodiment includes a rack 70 mounted to the top of the box channel 52. This rack 70 engages a pinion 72 that is rotated by an axial drive motor 74. Thus, operation of the motor 74 in a first direction will move the oscillating arm 50 outwardly along the oscillation axis 56, and reverse movement of the motor 74 will move the oscillating arm 50 in the reverse direction. The oscillating arm 50 supports two switch actuators 76 which cooperate with limit switches 78 mounted on non-oscillating portions of the frame 12. The outer switch actuator 76 in this embodiment is fixed, and the inner switch actuator 76 is adjustably positioned in any one of an array of receiving elements 80 for the switch actuator. In this embodiment the receiving elements 80 are formed as widened portions of an elongated groove, and the switch actuator 76 remains captured in the groove, with a spring force that retains the switch actuator 76 in the desired receiving element, as shown in FIG. 5. The limit switches 78 are connected in the manner shown in FIGS. 6A and 6B to control the direction of rotation of the motor 74, such that when the motor 74 is powered, the motor 74 automatically reverses direction to oscillate the oscillating arm 50 through a stroke, the length of which is determined by the position of the switch actuators 76.

A weld cleaning element 100 is rotatably mounted to the free end of the oscillating arm 50 and is rotated by a third drive system. This third drive system includes in this embodiment a shaft 102 to which the weld cleaning element 100 is mounted. The shaft 102 is mounted for rotation in a pivot arm 104. The pivot arm 104 is itself mounted to the oscillating arm 50 for rotation about a pivot axis 105. The inboard end of the shaft 102 supports a pulley 106 which is coupled by a belt 108 to a spindle motor 110. This motor 110 is positioned within a channel defined by the box channel 52 and centered on the pivot axis 105. Thus, pivotal movement of the pivot arm 104 about the pivot axis 105 does not alter tension on the belt 108, or interrupt the driving connection between the motor 110 and the weld cleaning element 100. When powered, the motor 110 drives the weld cleaning element 100 in rotation at a desired rotational velocity to effect proper cleaning of the pipe, without any substantial removal of metal of the pipe.

A spring 112 is mounted between the oscillating arm 50 and the pivot arm 104. The spring 112 in this embodiment is a gas spring which provides a degree of damping as well as a well-controlled biasing force tending to push the weld cleaning element 100 firmly against the pipe P1. It has been found that for at least some weld cleaning elements 100, a well-controlled biasing force is important to achieving a proper cleaning action. The provision of such a well-controlled biasing force is complicated by the fact that the weld cleaning element 100 will typically move over the weld being cleaned repeatedly as it oscillates. The spring 112 has been found to function reliably even in this difficult setting.

The motors 62, 74 and 110 are controlled and powered by electrical voltages supplied to the frame 12 via a control cable 120 and a control box 122.

Figure 3:
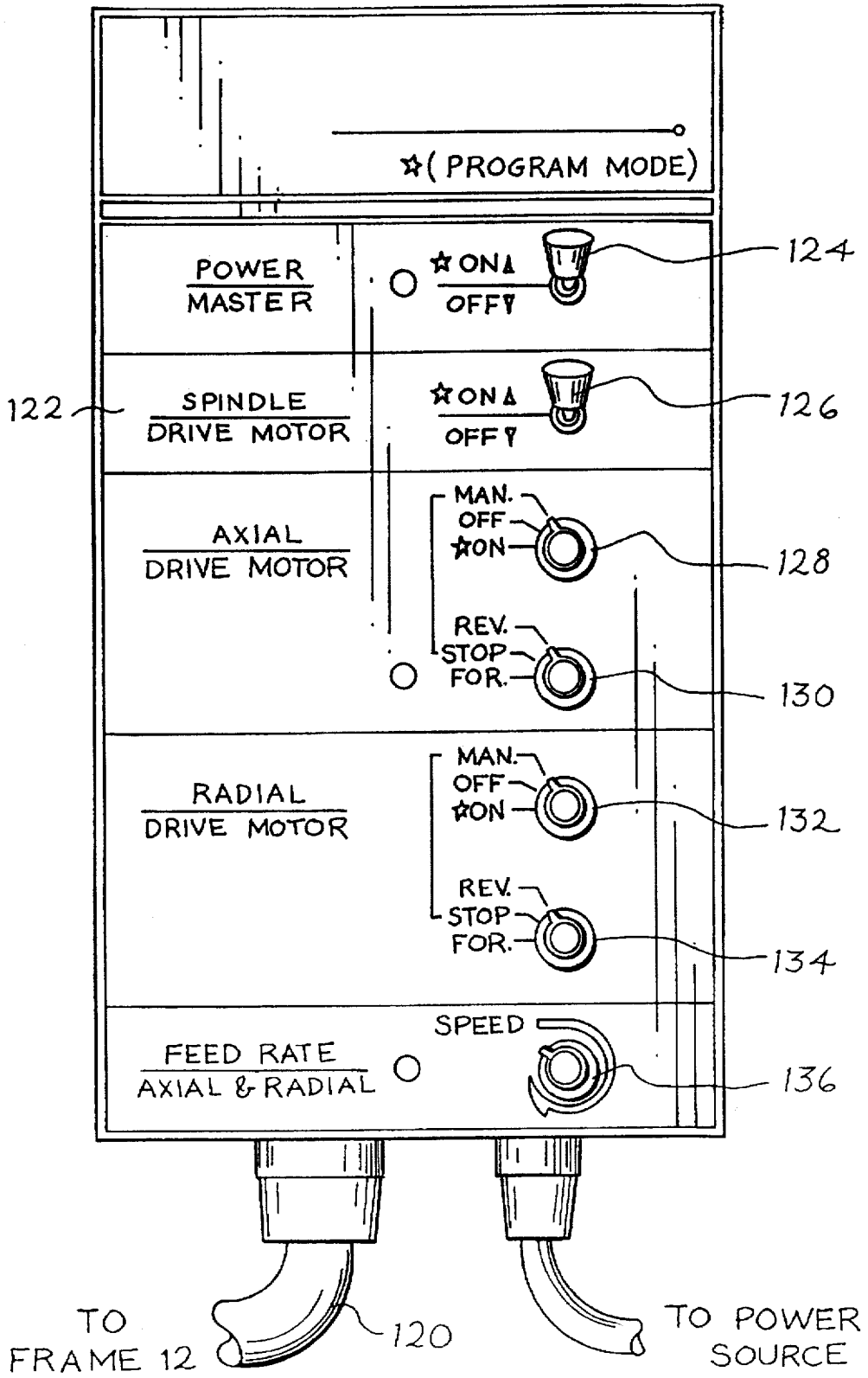
FIG. 3 is a front view of a control box used to control the weld cleaning machine of FIGS. 1 and 2.
Figure 6A:
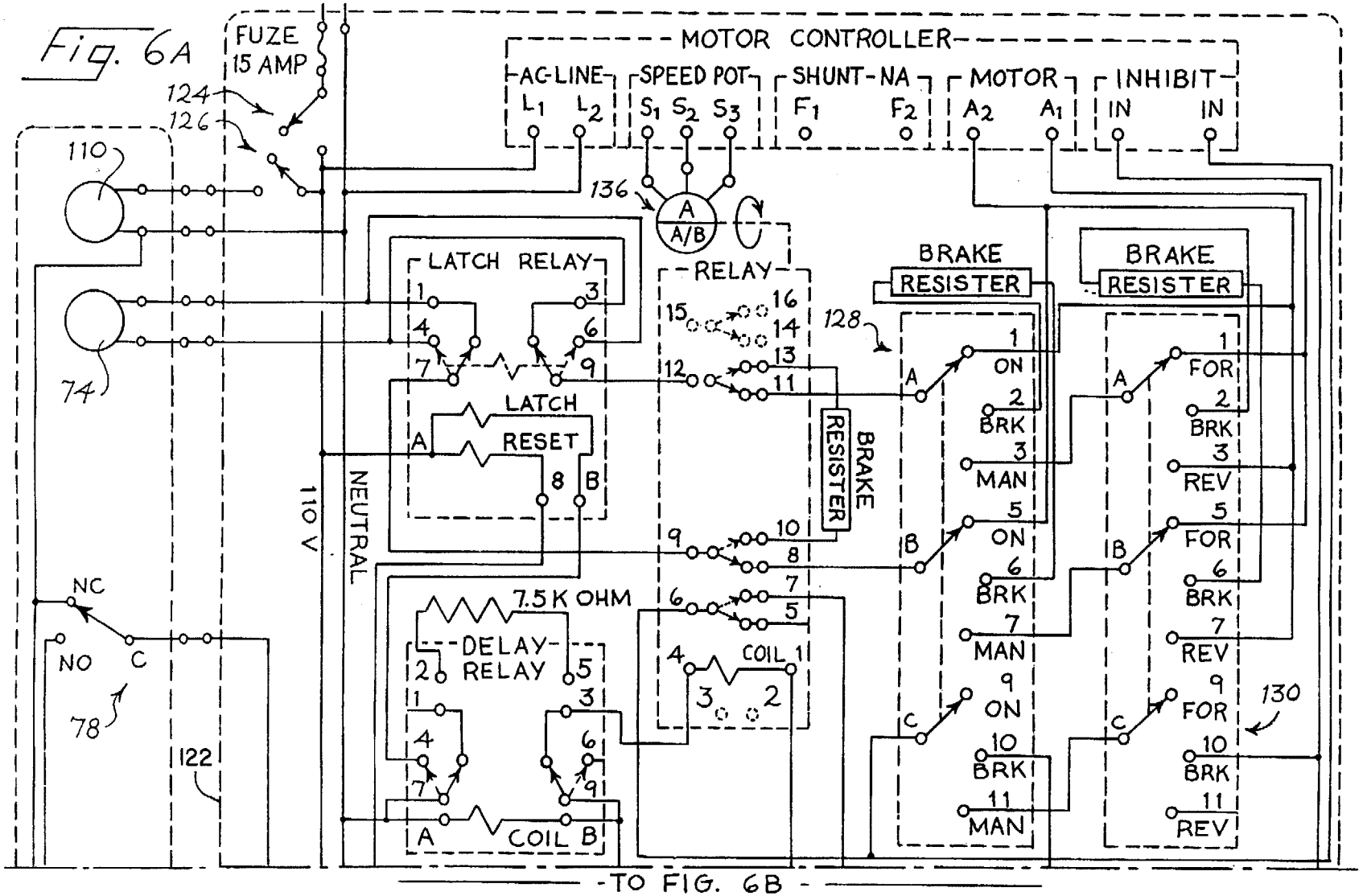
FIG. 6A is a first portion of an electrical schematic view of the weld cleaning machine of FIGS. 1, 2 and 4 and the control box of FIG. 3.
Figure 6B:
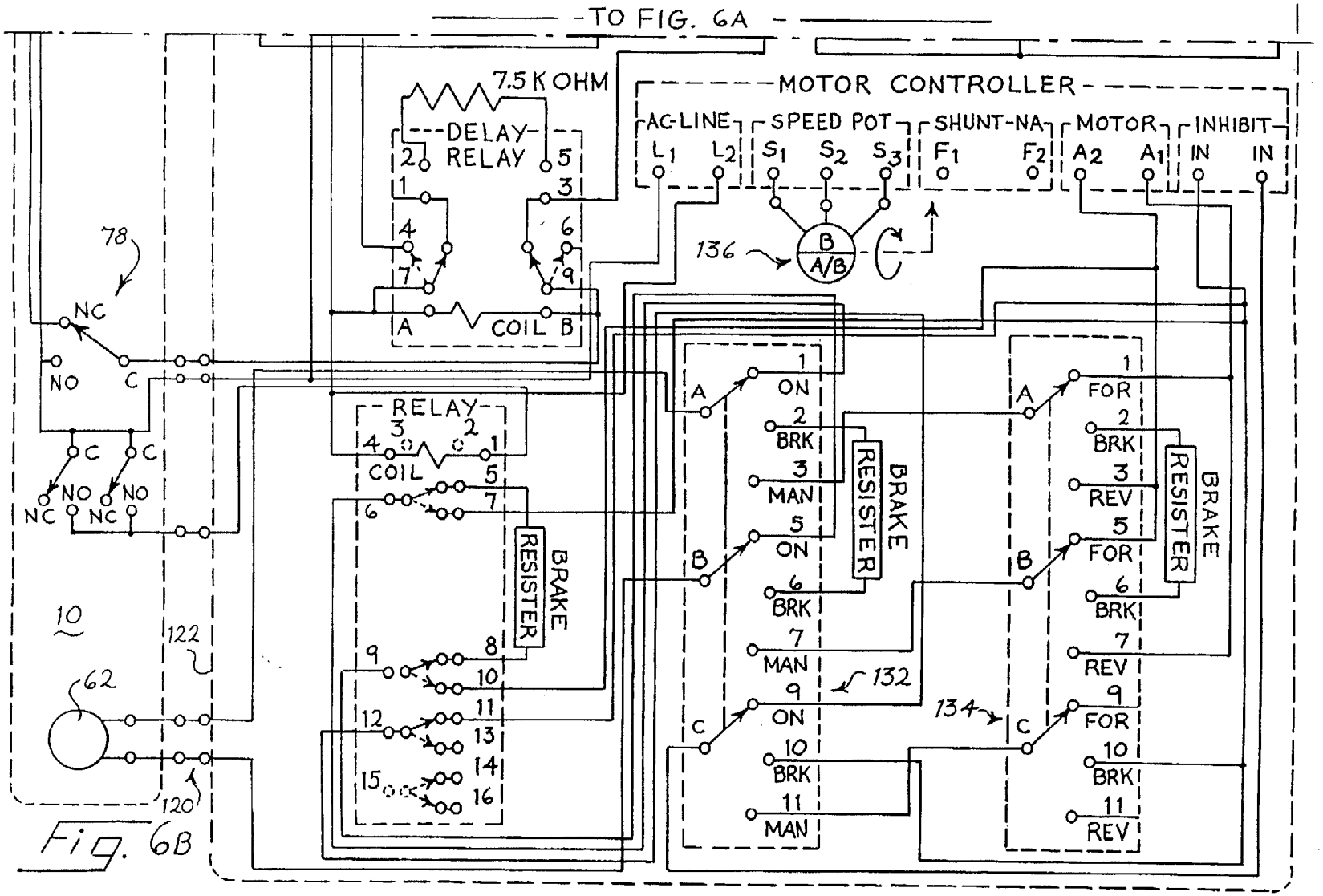
FIG. 6B is a second portion of the electrical schematic view of the weld cleaning machine of FIGS. 1, 2 and 4 and the control box of FIG. 3.

As best shown in FIGS. 3, 6A and 6B, the control box 122 includes an array of switches. The power switch 124 operates as a master switch to apply and remove power from all motors of the weld cleaning machine 10. The spindle drive motor switch 126 controls power to the motor 110 in an on/off fashion. The three-position mode switch 128 controls the axial drive motor 74 in one of three modes. When in the manual mode the user can use the switch 130 to position the oscillating arm 50, and therefore the weld cleaning element 100, at any desired position within the stroke. The second mode removes power from the oscillation drive motor 74, and the third mode labeled "*ON" places the oscillation drive motor 74 in the program mode described below.

Similarly, the mode switch 132 allows the user to control the mode for the radial drive motor 62. When in the manual mode the user can use the switch 134 to cause the motor 62 to rotate in a forward or reverse direction, or to stop. This allows the user to place the weld cleaning machine 10 at any desired location along the circumference of the pipe.

The mode switch 132 can also be used to remove power from the motor 62, or to place the motor 62 in the program mode.

The rotary control 136 allows the user to adjust the rate of rotation of the motors 62, 74 and thereby the radial and axial feed rate.

When the switches 124, 126, 128 and 132 are placed in the on positions, the weld cleaning machine 10 is operated in a program mode. In this mode the motor 74 automatically drives the oscillating arm 50 and the weld cleaning element 100 through the programmed stroke. In a synchronized matter the radial drive motor 62 is operated intermittently by the limit switches 78 such that the entire weld cleaning machine 10 is moved radially by a small increment each time the axial drive motor 62 reverses direction. The amount of this increment is controlled such that the surface portions of the pipe P1, P2 treated by the weld cleaning element 100 in adjacent strokes overlap to some extent. In this way the weld cleaning machine 10 will have cleaned a continuous annular strip around the circumference of the pipe P1, P2 once the weld cleaning machine 110 has traversed the complete circumference of the pipe P1, P2.

In alternative embodiments the radial drive motor 62 may be operated continuously rather than intermittently to achieve the same result. In this preferred embodiment all of the motors, 62, 74, 110, have been designed to operate on conventional 110 VAC power.

Figure 4:
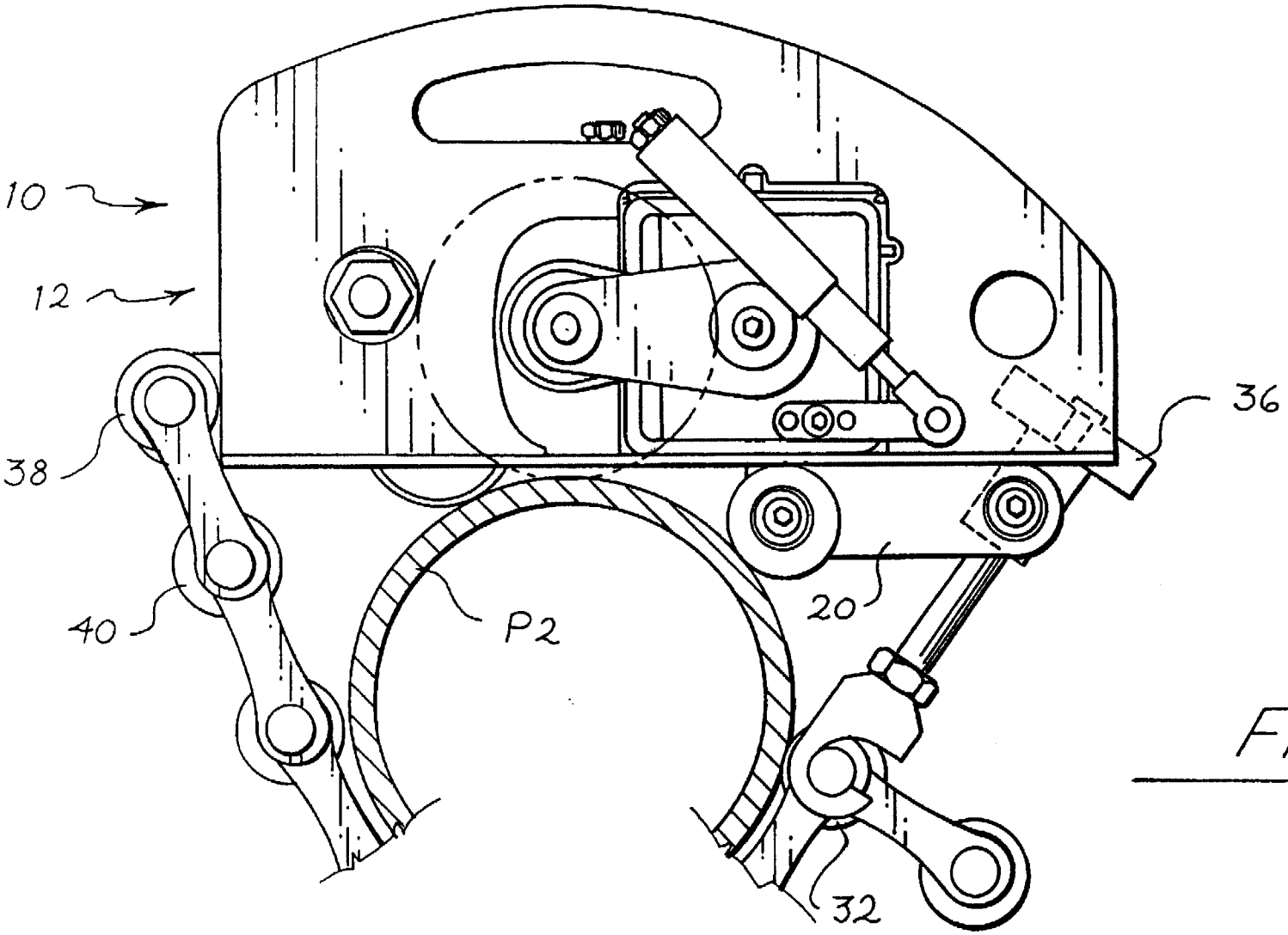
FIG. 4 is a side view of the weld cleaning machine of FIG. 1 shown mounted on a smaller diameter pipe.

In operation, a user first positions the sub-frame 20 appropriately with respect to the remainder of the frame 12 for the particular pipe to be cleaned. FIG. 4 shows the sub-frame 20 adjusted for a small diameter pipe P2. Of course, many intermediate positions are possible. Once the sub-frame 20 has been mounted in the proper position on the frame 12, the weld cleaning machine 10 is then mounted on the pipe P1, P2 by engaging the hooks 32, 38 with appropriate portions of the roller chain 40, and then tightening the roller chain 40 with the handle 36.

The user also positions the switch actuator 76 to achieve the desired stroke, i.e. the desired axial length of the region of the pipe to be cleaned.

At this point the user can move away from the pipe P1, P2 to reduce radiation exposure to the user if the pipe is a source of ionizing radiation. The user then operates the control box 122 to apply power to the motor 110 to cause the weld cleaning element 100 to rotate. Additionally, power is applied to the motor 62 to cause the frame 12 to rotate circumferentially around the pipe P1, P2. Power is simultaneously applied to the motor 74 to move the weld cleaning element 100 axially through the desired stroke.

The preferred embodiment described above provides a number of important advantages. First, because of the combination of the rotation of the frame and the oscillation of the weld cleaning element 100, the weld cleaning machine 10 cleans a circumferential strip around the pipe P1, P2 which is substantially longer (measured axially along the length of the pipe) than the axial length of the weld cleaning element 100. Furthermore, the axial length of this cleaned strip can easily be changed by properly adjusting the switch actuator 76.

Second, the control cable 120 and control box 122 allow the user to stand at a considerable distance from the pipe being cleaned during the cleaning operation, thereby minimizing radiation exposure to the user.

Third, the sub-frame 20 can readily be repositioned on the frame 12 to adapt the weld cleaning machine 10 to a wide range of pipe sizes.

Fourth, the spring 112 provides a well-controlled biasing force for the weld cleaning element 100 against the pipe P1, P2. Because the motor 110 does not move radially with respect to the pipe P1, P2 and frame 12, the weight of the motor 110 is not a substantial consideration when the weld cleaning machine 10 is inverted. It is only the weld cleaning element 100, the shaft 102, the pivot arm 104 and the pulley 106 that are biased by the spring 112, and these elements can easily be made relatively low in mass such that the biasing force applied to the weld cleaning element 100 against the pipe P1, P2 does not vary substantially as the weld cleaning machine 10 passes from an upright position on the top of the pipe to an inverted position at the bottom of the pipe, when the pipe is horizontally situated.

The following details of construction are provided merely to define the best mode of the invention presently contemplated by the inventors. It should be clearly understood that these details of construction are intended only by way of example, and that they do not in any way limit the scope of the invention.

Presently preferred suppliers for various elements of the weld cleaning machine 10 are identified in Table 1 as follows:

TABLE 1

| Reference Number | Element | Preferred Embodiment |
|---|---|---|
| 62 | Drive Motor | Globe Motor 102A933-8 |
| 74 | Motor | Globe Motor 102A1062-5 |
| 110 | Motor | Matabo DG 251 |
| | Motor Controller | Minarik XL3025 |
| 40 | Roller Chain | Wachs 29-402-00 |
| 100 | Weld Cleaning Element | 3M Scotch Bright clean and strip disc (CS-DC) 4" dia × ½" thick (XCS grade) |

Simply by way of example, the first drive system can rotate the drive wheel 60 such that the weld cleaning machine 100 moves at a circumferential velocity of 0.86 in/sec. The motor 74 can oscillate the oscillating arm 50 through a stroke of 7 in (max) at a rate of 0.635 in/sec. The motor 10 can rotate the weld cleaning element 100 at a rotational velocity of 9000 RPM (free speed) 5900–6000 RPM (loaded), and the weld cleaning element 100 can have a diameter of about four inches.

Figure 7:
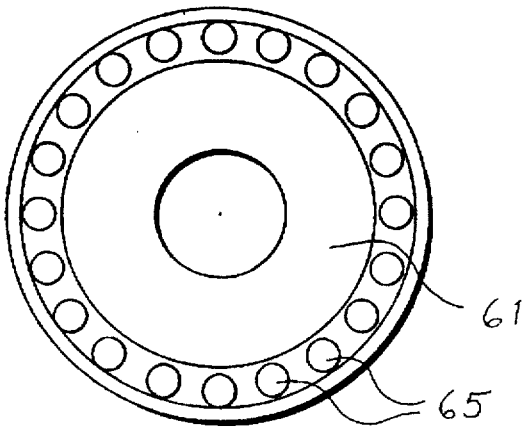
FIG. 7 is a side view of a hub of one of the drive wheels of the weld cleaning machine of FIGS. 1 and 2.
Figure 8:
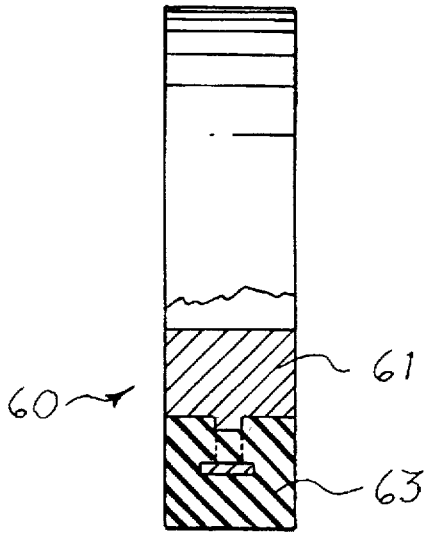
FIG. 8 is an edge view in partial section of one of the drive wheels of the weld cleaning machine of FIGS. 1 and 2.

The drive wheels 60 preferably provide a high degree of friction against the pipe P1, P2 in order to ensure reliable circumferential motion. FIGS. 7 and 8 show one preferred arrangement which has been found to achieve this result. As shown in FIG. 7, the drive wheel includes a metal hub 60 which includes an array of apertures 65 spaced around the perimeter. The drive wheel 60 also includes an elastomeric tire 63 which is molded in place on the hub 61, mechanically interlocked with the openings 65. Preferably, the tire 63 is made of a polymeric material such as that supplied by Mobay Corporation under the tradename TEXIN 355-D. This material has a hardness of 50 on the Shore D scale. A suitable bonding adhesive such as that supplied by Morton Adhesives under the tradename THIXON 405 is preferably used to secure the tire 63 to the hub 61.

A guard (not shown) may be positioned over the weld cleaning element 100 to collect debris and to prevent inadvertent contact with the element 100. The pivot arm 104 may have a detent mechanism to hold the element out of contact with the pipe P1, P2 during installation and set up.

At various points in the foregoing description and the following claims, two elements are said to be coupled together. The term "coupled" is intended to the interpreted broadly to cover a wide range of linkages and structures in which forces are transferred directly or indirectly between elements with or without intervening elements.

Of course, many changes and modifications are possible to the preferred embodiment described above. For example, the various aspects of the invention described initially above can be used independently of one another, and they do not have to be used in combination as described above.

Additionally, the mounting means provided by the pivot arm 104 can be modified substantially. The essential point is that the weld cleaning element 100 be allowed to move with respect to the frame toward and away from the pipe. Various linear, pivoting and other linkages are well known to those skilled in the art, and can readily be adapted for use in the mounting means.

Furthermore, the three drive systems described above can all be modified substantially to use any suitable combination of gears, belts, chains or other drive systems to achieve the desired motions. Those skilled in the art are aware of a wide variety of drive systems that can be adapted for use to achieve the basic motions described above.

It is therefore intended that the foregoing detailed description be regarded as illustrative rather than limiting, and that it be understood that it is the following claims, including all equivalents, which are intended to define the scope of this invention.

We claim:

1. A weld cleaning machine comprising:

a frame;

a band comprising first and second portions, each of the first and second portions is coupled to the frame to hold the frame against a pipe;

a weld cleaning element mounted to the frame for oscillation along an oscillation axis positioned at a non-zero angle with respect to the band;

a first motorized drive system mounted on the frame to rotate the frame around the pipe; and a second motorized drive system mounted on the frame to oscillate the weld cleaning element along the oscillation axis.

2. The machine of claim 1 further comprising a third motorized drive system for rotating the weld cleaning element about the oscillation axis.

3. The machine of claim 2 wherein the weld cleaning element comprises a rotary abrasive pad.

4. The machine of claim 2 further comprising:

a control cable connected to at least the first, second and third drive systems; and a control panel connected to the control cable to control the first, second and third drive systems remotely.

5. The machine of claim 1 wherein the band comprises a roller chain.

6. The machine of claim 1 wherein the first drive system comprises a pair of drive wheels positioned on a drive axis to roll around the pipe, wherein the frame supports a pair of guide wheels positioned on a guide axis to roll around the pipe, and wherein the oscillation axis for the weld cleaning element is positioned between the drive axis and the guide axis.

7. The machine of claim 1 wherein the frame comprises:

a channel-defining member aligned with the oscillation axis;

at least one guide mounted to the frame to guide the channel-defining member along the oscillation axis; and wherein the second drive system comprises:

a motor coupled to the channel to oscillate the channel along the oscillation axis;

a pair of limit switches on the frame; and a pair of switch actuators on the channel-defining member, said switch actuators positioned to engage the limit switches to limit a stroke through which the motor oscillates the channel-defining member.

8. The machine of claim 7 wherein the channel-defining member comprises multiple receiving elements, and wherein one of the switch actuators is received in any selected one of the receiving elements to vary the stroke.

9. The machine of claim 7 further comprising:

a third motorized drive system for rotating the weld cleaning element about the oscillation axis, said third motorized drive system comprising an additional motor received in the channel-defining member.

10. The machine of claim 1 wherein the frame comprises at least one side plate, and wherein the side plate forms a gripping opening sized to receive a portion of a hand to facilitate handling of the weld cleaning machine.

11. The machine of claim 1 wherein the first drive system comprises a pair of drive wheels positioned on a drive axis to roll around the pipe, wherein the frame comprises a sub-frame comprising a pair of guide wheels positioned on a guide axis to roll around the pipe, and wherein the sub-frame is movably mounted on the frame to allow adjustment of separation between the drive and guide axes.

12. The machine of claim 1 further comprising a spring coupled between the frame and the weld cleaning element to resiliently bias the weld cleaning element against the pipe.

13. The machine of claim 1 wherein the frame comprises a support element guided for oscillation with respect to the band along the oscillation axis, wherein the weld cleaning element is rotatably mounted to a pivot arm, wherein the pivot arm is rotatably mounted to the support element, and wherein a spring is coupled between the support element and the pivot arm to resiliently bias the weld cleaning element against the pipe.

14. A weld cleaning machine comprising:

a frame;

a band comprising first and second portions coupled to the frame to hold the frame against a pipe;

a weld cleaning element mounted to the frame for oscillation along an oscillation axis positioned at a non-zero angle with respect to the band;

a first motorized drive system mounted on the frame to rotate the frame around the pipe; and a second motorized drive system mounted on the frame to oscillate the weld cleaning element along the oscillation axis;

a control cable connected to at least the first drive system; and a control panel connected to the control cable to control the first drive system remotely.

15. A weld cleaning machine comprising:

a frame;

a band comprising first and second portions coupled to the frame to hold the frame against a pipe;

a weld cleaning element mounted on the frame to contact the pipe;

a first motorized drive system mounted on the frame to rotate the frame around the pipe;

a control cable connected to at least the first drive system; and a control panel connected to the control cable to control the first drive system remotely.

16. The machine of claim 15 wherein the control panel comprises a forward/reverse direction selection switch and an on/off control switch, said switches controlling respective functions of the first motorized drive system.

17. A weld cleaning machine comprising:

a frame;

a band comprising first and second portions coupled to the frame to hold the frame against a pipe;

a weld cleaning element mounted on the frame to contact the pipe;

a first motorized drive system mounted on the frame to rotate the frame around the pipe;

said first motorized drive system comprising a pair of drive wheels mounted for rotation about a drive axis to roll around the pipe, and a drive motor coupled to the drive wheels; and said frame comprising a sub-frame comprising a pair of guide wheels positioned on a guide axis to roll around the pipe, said sub-frame movably mounted on the frame to allow adjustment of separation between the drive and guide axes.

18. The machine of claim 17 wherein the first portion of the band is positioned on one side of the drive axis, and wherein the second portion of the band is positioned on the other side of the guide axis.

19. A weld cleaning machine comprising:

a frame;

a band comprising first and second portions coupled to the frame to hold the frame against a pipe;

a first motorized drive system mounted on the frame to rotate the frame around the pipe;

a weld cleaning element mounted to the frame;

a motor coupled to rotate the weld cleaning element;

means for mounting the weld cleaning element for movement with respect to the frame toward and away from the pipe; and a spring coupled between the mounting means and the weld cleaning element and operative to bias the weld cleaning element against the pipe.

20. The machine of claim 19 wherein the mounting means comprises a pivot arm, wherein the weld cleaning element is pivotably mounted with respect to the pivot arm, wherein the pivot arm is pivotably mounted with respect to the frame, wherein the spring is coupled between the pivot arm and the frame, and wherein the weld cleaning element is coupled to the motor by a drive belt.

* * * * *